US006053728A

United States Patent [19]

Alchalabi et al.

[11] Patent Number: 6,053,728

[45] Date of Patent: Apr. 25, 2000

[54] FURNACE

[75] Inventors: Rifat Alchalabi, Fanwood, N.J.; Adam DeBoskey, Ann Arbor, Mich.; James F. McElroy, 3rd, Springfield, N.J.

[73] Assignee: The BOC Group, Inc., New Providence, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 09/031,994

[22] Filed: Feb. 27, 1998

[51] Int. Cl.[7] ..... F27B 3/18

[52] U.S. Cl. ..... 432/161; 432/179

[58] Field of Search ..... 432/161, 179, 432/180, 181; 126/343.5 A, 343.5 R

[56] References Cited

U.S. PATENT DOCUMENTS

| | | | |
|---|---|---|---|
| 1,279,697 | 9/1918 | Hook | 432/161 |
| 2,331,052 | 10/1943 | Shadduck | 373/27 |
| 3,501,134 | 3/1970 | Knaak et al. | 432/196 |
| 3,759,157 | 9/1973 | Larkfeldt et al. | 454/305 |
| 5,069,715 | 12/1991 | Reid | 75/414 |
| 5,853,448 | 12/1998 | Duchateau et al. | 65/134.4 |

*Primary Examiner*—Teresa Walberg
*Assistant Examiner*—Jiping Lu
*Attorney, Agent, or Firm*—Salvatore P. Pace

[57] ABSTRACT

A furnace having sidewalls to form an enclosure to contain a melt. One or more burners are positioned to fire into the enclosure to maintain the melt and one or more charge wells are separated from the enclosure by the sidewalls. A charge of material to be melted is loaded into the charge wells and melted. Submerged openings defined in the sidewall circulate melt to the charge well(s) and to circulate the melt back to the enclosure. Submerged pumps effectuate the circulation. Flue gas openings defined in the sidewall(s) are configured to direct flue gas into the charge well(s) and on to said the charge of material. Two opposed charge wells and pumps may be provided as wells as flue gas openings to heat the charge of material deposited into the charge wells. The flue gas openings allow flue gas to impinge onto the charge of material to be melted so that heat that would otherwise be lost in the flue gas is used to help melt the charge of material.

7 Claims, 4 Drawing Sheets

FURNACE

BACKGROUND OF THE INVENTION

The present invention relates to a furnace in which one or more burners fire into a furnace to heat a melt and the material used in forming the melt is loaded into the furnace through adjacent charge wells. More particularly, the present invention relates to such a furnace in which flue gases produced within the furnace are directed onto material loaded into the charge wells through openings defined in the sidewalls of the furnace.

Many industrial processes require material such as scrap metal to be melted within furnaces. Oxy-fuel burners such as disclosed in U.S. Pat. No. 5,299,929 have been advantageously used to deflect flames over the material to be melted within the furnace.

A known furnace design utilizes sidewalls to form an enclosure to contain a melt. One or more burners fire into the furnace to maintain the melt and one or more adjacent charge wells are proved to load material to be melted into the furnace. Submerged openings, also known as submerged arches, are provided to circulate melt to the charge wells, thereby to help melt the material used in forming the melt and to recirculate melted material back to the furnace. Submerged pumps are used to effect the required circulation of melted material to and from the charge wells to the main melting chamber of the furnace.

In any furnace, it is important that the combustion take place in the most thermally efficient manner in order to conserve both fuel and oxidant. However, in conventional furnaces such as described above, there are heat losses due to flue gases being vented from the furnace. Flue gases as known in the art are heated gases made up of the furnace atmosphere which can include combustion products and any volatiles evolved from the melt. As will be discussed, the present invention provides improvement to furnaces such as outlined above by utilizing the flue gases in a thermally efficient manner.

SUMMARY OF THE INVENTION

The present invention provides a furnace comprising sidewalls forming an enclosure to contain a melt. One or more burners are positioned to fire into the enclosure to maintain the melt. At least one charge well is separated from the enclosure by one of the sidewalls. The charge well functions to contain a charge of material to form the melt. Submerged openings are defined in the one sidewall to circulate melt to the at least one charge well and to circulate the melt back to the enclosure. At least one submerged pump is positioned to circulate the melt between the charge well and the enclosure. Flue gas openings are defined in the one sidewall and are to direct flue gases into the at least one charge well and to impinge onto the charge of material to be melted. In such manner, the energy can be extracted from the flue gases lost in the flue gas is advantageously used to heat material that forms the melt. It has been predicted by the inventors herein that such advantageous use of the flue gases can effect up to a 25% savings in energy.

BRIEF DESCRIPTION OF THE DRAWINGS

While the specification concludes with claims distinctly pointing out the subject matter that Applicants regard as their invention, it is believed that the invention will be better understood when taken in connection with the accompanying drawings in which:

It should be noted that in order to avoid need repetition, where the same elements are used in different embodiments, the same reference numbers have been retained in the various figures. Likewise, where the same type of elements are included in a single figure, the reference numbers for such like elements are labeled "a" and "b". In all of the figures, the circulation of the melt is shown by unlabelled arrowheads.

DETAILED DESCRIPTION

Figure 1:
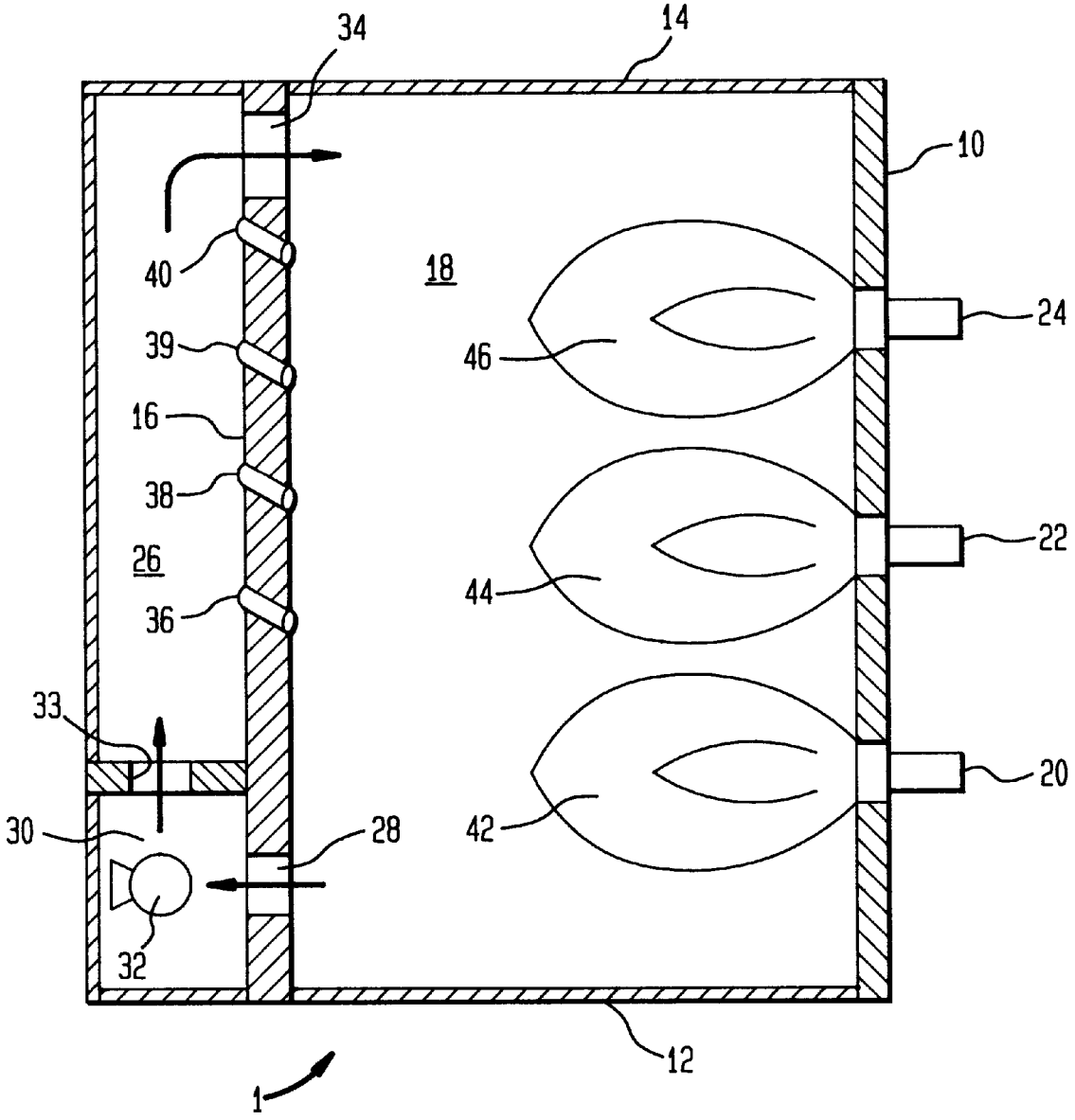
FIG. 1 is a top plan schematic view of a furnace in accordance with the present invention.

With reference to FIG. 1, the furnace 1 in accordance with present invention is illustrated. Furnace 1 has sidewalls 10, 12, 14, 16 that define an enclosure 18 for containing a melt. Burners 20, 22 and 24 fire into enclosure 18 to maintain the melt. Although no particular form of burner is preferred, oxy-fuel burners such as described in U.S. Pat. No. 5,299,929 can be used.

A charge well 26 is separated from the closure by sidewall 16. A charge, such as scrap metal to be melted, is loaded into charge well 26. A submerged opening 28 admit melt into a pumping chamber 30 containing a pump 32. Pump 32, pumps melt through another submerged opening 33 into charge well 26. The heated melt acts to melts the charge loaded into charge well 26. A submerged opening 34 is provided to recirculate melted material back into enclosure 18.

Flue gas openings 36, 38, 39, and 40 are provided to circulate flue gas produced by the combustion of burners 20, 22 and 24 onto material to be melted that has been loaded into charge well 26. As shown, in order to prevent heat loss through radiation, the flue gas openings 36, 38, 39, and 40 are oriented downwardly oriented at an angle with respect to flames 42, 44 and 46.

Figure 2:
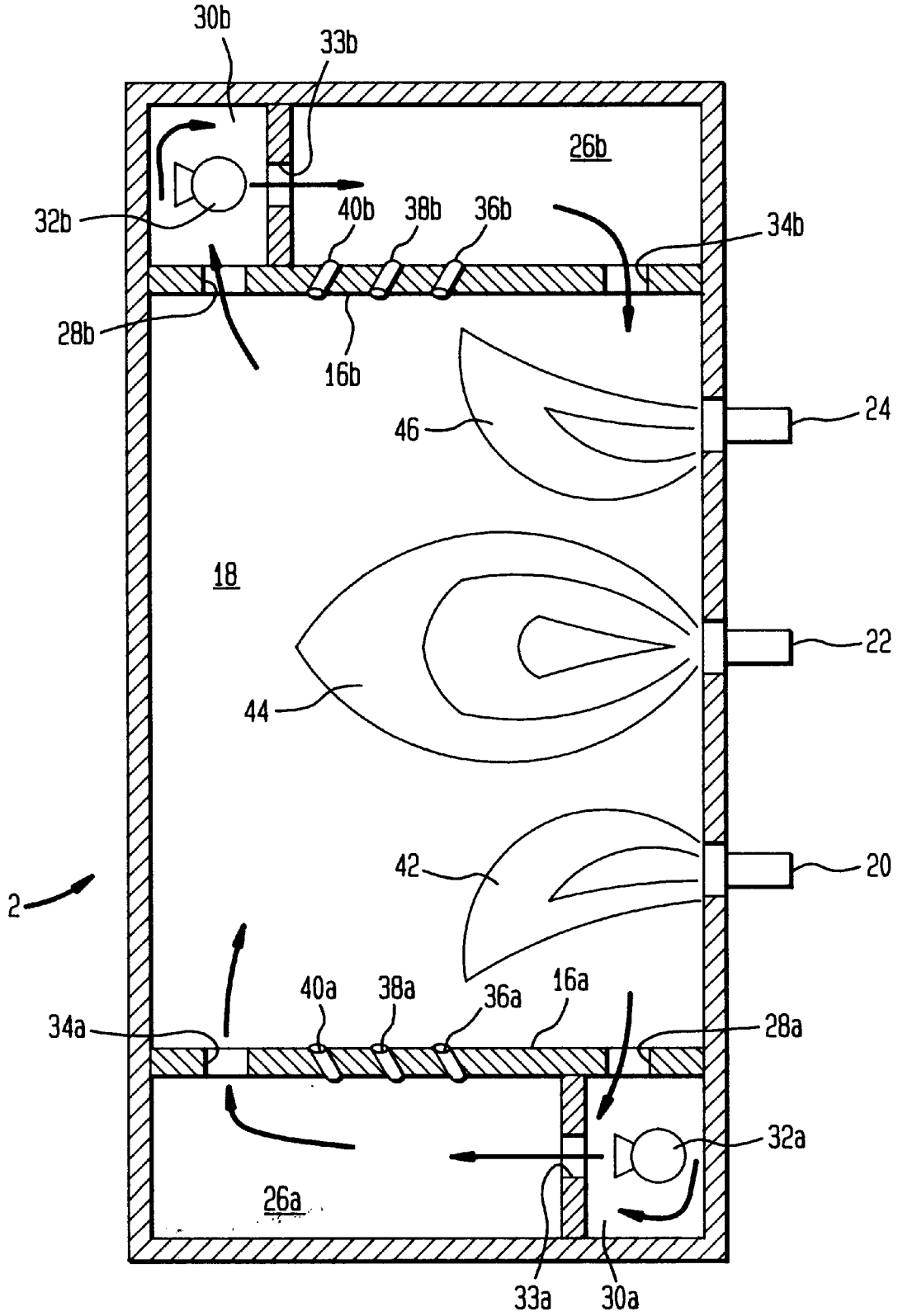
FIG. 2 is an alternative embodiment of a furnace in accordance with the present invention.
Figure 3:
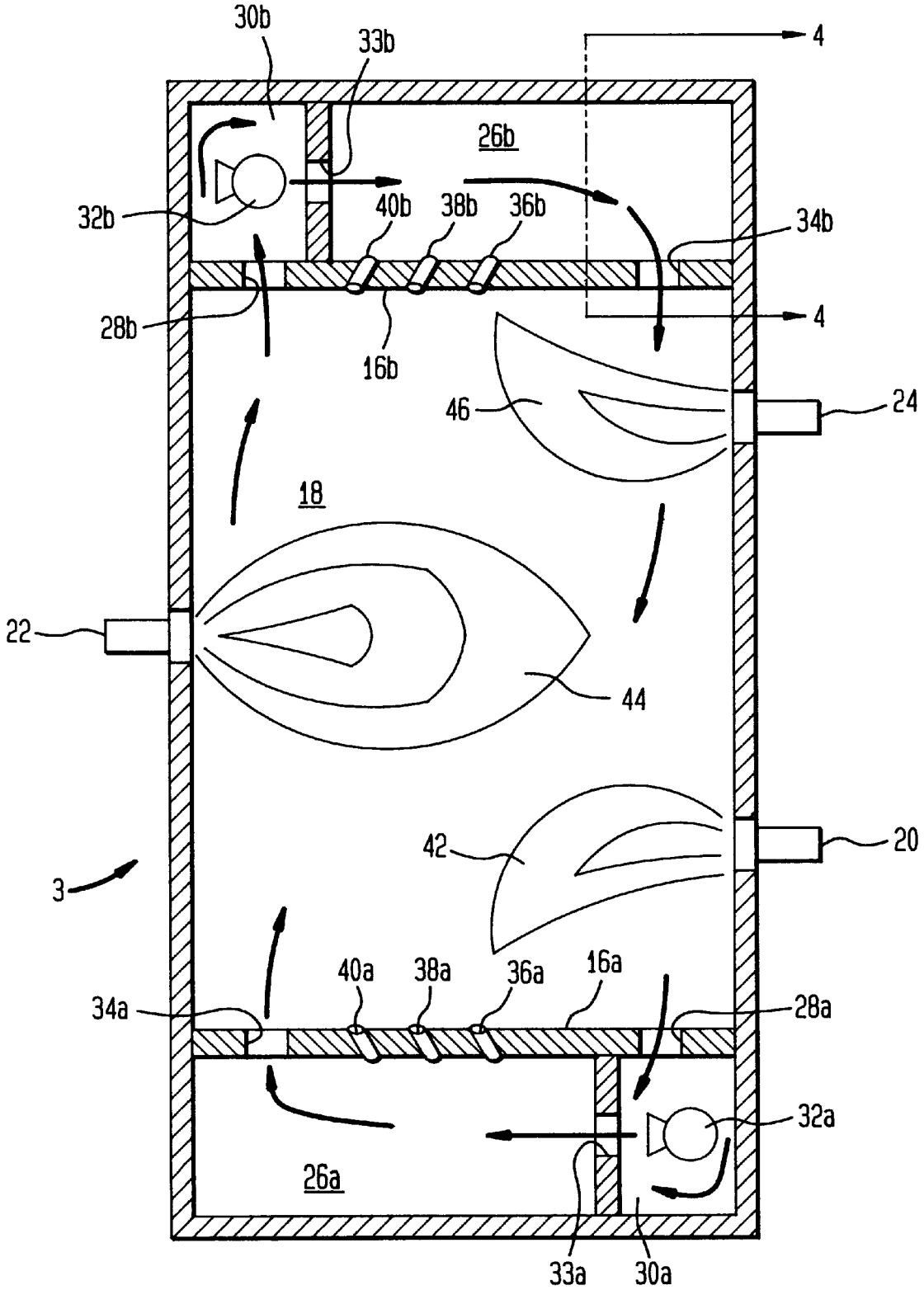
FIG. 3 is yet an alternative embodiment in the present invention.

As would be known to those skilled in the art, one or more burners could be used in accordance with an embodiment of the present invention. Moreover, multiple charge wells could be used. Such multiple charge wells allow high production yield, a redundant pump to provide for continued operation during pump maintenance and greater flexibility in scrap handling. In this regard, with reference to FIG. 2, a furnace 2 in accordance with the present invention as illustrated. Furnace 2 has two opposed charge wells 26*a* and 26*b* to pumping chambers 30*a* and 30*b* containing pumps 32*a* and 32*b*. Submerged openings 28*a*, 33*a*, and 34*a* circulate melt and material to be melted to and from enclosure 18 and charge well 26*a*. Similarly, submerged openings 28*b*, 33*b* and 34*b* allows circulation of melted material between charge well 26*b* and enclosure 18. Sets of flue gas openings 36*a*, 38*a* and 40*a* are provided to circulate flue gas to charge wells 26*a* and flue gas openings 36*b*, 38*b* and 40*b* are provided to circulate flue gas to charge wells 26*b*. With additional reference to FIG. 3, a further alternative embodiment is illustrated having two opposed charge wells in which burner 22 is positioned opposite to and so as to fire between burners 20 and 24 for increased flame coverage.

Although not illustrated, but as could be appreciated by those skilled in the art, the furnaces 1, 2, and 3 can be situated within enclosed buildings. In such case charge wells 26, 26*a*, and 26*b* can be hooded to discharge cooled flue gases and the like out enclosed buildings.

Figure 4:
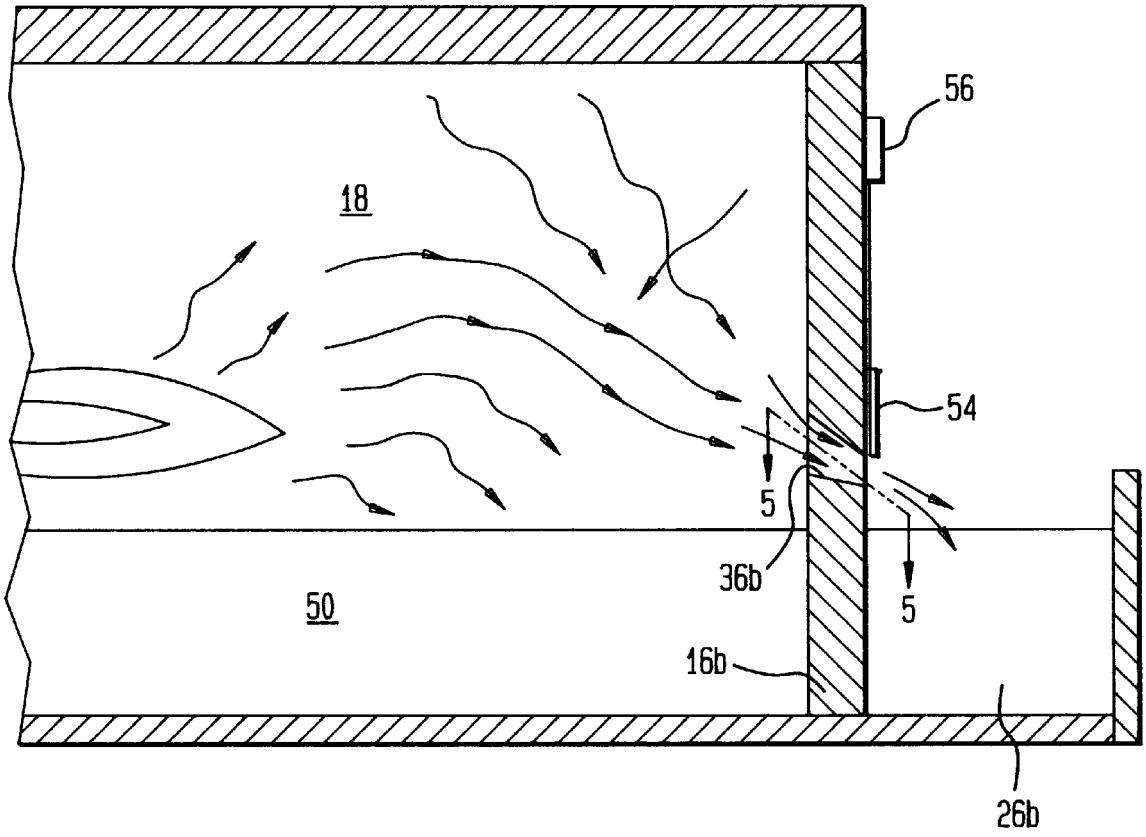
FIG. 4 is a sectional view of the FIG. 3 taken along line 4—4 thereof.
Figure 5:
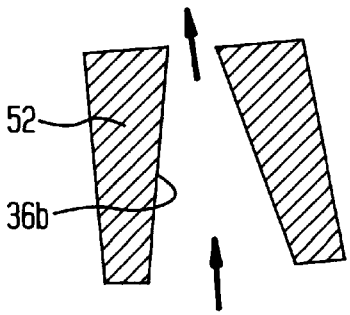
FIG. 5 is a sectional view taken along line 5—5 of FIG. 4.

With reference to FIG. 4, melt 50 is illustrated as being contained within enclosure 18. As indicated, each of the aforementioned flue gas openings, 36, 38 39, and 40 or 36*a*, 38*a* and 40*a* or 36*b*, 38*b* and 40*b* are downwardly directed and have an ever narrowing cross-sectional areas, as indicated in FIG. 5, to direct the flue gases down to the melt. The ever narrowing cross-sectional areas accelerate the flue gases to impinge on the melt and increase heat transfer between the flue gases and the material or charge to be melted. Additionally exothermic heats of recombination at the melt surface is enhanced. The downward inclination from the vertical not only directs flue gases to the charge but also prevents the escape of radiant energy. Preferably such downward inclination should be anywhere in a range of between about 10 degrees and about 60 degrees with an inclination of about 30 to 40 degrees being particularly preferred. The illustrated opening 36B (or any of the other openings for that matter) can be formed within a separate burner block 52 set within sidewall 16*b* (or any of the other sidewalls). A sliding door 54 raised and lowered by a motor 56 can be provided to selectively shut-off any of the flue gas openings. For instance, if a charge of material is loaded to one side of any of the charge wells, then a flue gas opening for the other unloaded side might be closed off.

While the present invention has been described with reference to a preferred embodiment, as will occur to those skilled in the art, numerous additions, omissions and changes may be made without departing from the spirit and scope of the present invention.

We claim:

1. A furnace comprising:

sidewalls forming an enclosure to contain a melt;

at least one burner positioned to fire into said enclosure to maintain said melt;

at least one charge well separated from said enclosure by one of said sidewalls to contain a charge of material to form said melt;

submerged openings defined in one sidewall to circulate melt to said at least one charge well and to circulate said melt and said material back to said enclosure;

at least one submerged pump positioned to circulate said melt between said charge well and said enclosures; and flue gas openings defined in said one sidewall and configured to direct flue gas into said at least one charge well and to impinge onto said charge of material to be melted.

2. The furnace of claim 1, wherein each of said flue gas openings has an ever decreasing cross-sectional area to accelerate said flue gas.

3. The furnace of claim 1 or claim 2, wherein said flue gas openings are downwardly angled from the vertical in a range of between about 10 degrees and 60 degrees.

4. The furnace of claim 1 or claim 2, wherein said flue gas openings are downwardly angled from the vertical in a range of about 30 degrees and about 40 degrees.

5. The furnace of claim 1, wherein:

two of said charge wells are situated opposite to one another so as to be separated from one another by said enclosure with one of said two charge wells separated from said enclosure by said one sidewall and the other of the two charge wells separated from said enclosure by another sidewall; two of said submerged pumps are associated with each of said two charge wells; and said flue gas openings are also defined in said another sidewall.

6. The furnace of claim 1, wherein three of said burners are provided and positioned so that one of said burners fires is situated opposite to and fires between the other two of said burners.

7. The furnace of claim 1, wherein sliding doors are associated with each of said flue gas openings to selectively close off each of said flue gas openings.

* * * * *